US005615635A

United States Patent [19]

Deviney

[11] Patent Number: 5,615,635

[45] Date of Patent: Apr. 1, 1997

[54] CUP PLACEMENT INDICATOR

[76] Inventor: Jerry P. Deviney, 1511 Casar Lawndale Rd., Casar, N.C. 28020

[21] Appl. No.: 522,981

[22] Filed: Jul. 11, 1995

[51] Int. Cl.[6] ..... G09F 17/00

[52] U.S. Cl. ..... 116/173; 116/209; 473/176

[58] Field of Search ..... 116/173, 174, 116/175, 209; 473/176, DIG. 30

[56] References Cited

U.S. PATENT DOCUMENTS

| | | | |
|---|---|---|---|
| 1,582,931 | 5/1926 | Kennedy | 116/173 |
| 1,670,176 | 5/1928 | Woolery . | |
| 2,711,712 | 6/1955 | Reed, Jr. | 116/174 |
| 2,794,414 | 6/1957 | Reifschneider | 116/173 |
| 3,119,370 | 1/1964 | Keats | 116/173 |
| 3,240,183 | 3/1966 | Walter et al. | 116/173 |
| 3,477,161 | 11/1969 | Drexler | 116/174 X |
| 3,732,845 | 5/1973 | Istre | 117/173 |
| 3,997,993 | 12/1976 | Flaherty | 40/218 |
| 4,018,182 | 4/1977 | Knaack | 116/173 |
| 4,664,386 | 5/1987 | O'Neal, Jr. | 273/176 |
| 4,813,369 | 3/1989 | Moreland | 116/173 |
| 4,905,624 | 3/1990 | Krolzick | 116/173 |
| 5,029,855 | 7/1991 | Jamieson et al. . | |
| 5,230,297 | 7/1993 | Lakatos | 116/209 |
| 5,423,282 | 6/1995 | Krull et al. | 116/209 |

*Primary Examiner*—William A. Cuchlinski, Jr.
*Assistant Examiner*—Willie Morris Worth
*Attorney, Agent, or Firm*—Gerald R. Boss; Cort Flint; Henry S. Jaudon

[57] ABSTRACT

A detachable cup indicator is provided for connection to a golf flag stick for indicating the cup position on a putting green. A flag holder having a flag stick attachment for releasably attaching a series of detachable coded flags is adapted for being received by a flag stick. A series of coded flags including a first golf flag having a first design for indicating a first placement of the golf hole on the green and a second golf flag having a second design for indicating a second placement of the golf hole on the green are interchangeably attached to the flag holder for indicating the position of the golf cup on the green.

16 Claims, 4 Drawing Sheets

CUP PLACEMENT INDICATOR

BACKGROUND OF THE INVENTION

This invention relates generally to a device for usually indicating cup placement on a golf green, and, more particularly, to a device including a flag holder adapted for being slidably received over the top end of a golf flag stick with detachable interchangeable coded golf flags which are coded for indicating the cup or hole placement on the green.

The game of golf is a very popular sport. The object of the game is to strike a ball from a tee toward a target hole. The target hole is located around an area known as a green. The green is a smooth surface of close cut grass from which the golfer putts the ball into the hole. Prior to putting the ball into the hole, generally, the golfer aims his ball from a fairway to the green. Accordingly, it is important for the golfer to know the distance to the target hole. However, the location of the target hole is routinely changed during various rounds of tournaments and during the golf season both for strategic purposes and for maintaining even wear of the green thus making it difficult for the golfer to know exactly where the golf hole is in position on the green. Accordingly, there is a need for a device to indicate the location of the cup on the golf green so the golfer may ascertain where the hole is located from the fairway.

U. S. Patent Nos. 4,905,624; 3,732,845; and 3,240,183 all disclose devices either made from metal or plastic which are designed to be slidably attached to the flag stick for indicating the location of the hole on to the green. These devices are placed high on the flag stick to indicate a distant pin location, mounted in the middle of the flag stick for indicating a middle position on the green, and mounted on a low position to indicate the pin location close to the front of the green. Each of these devices have certain disadvantages. For instance, U.S. Pat. No. 3,732,845 requires a special flag stick, a special cup holder, and a special attachment device comprising numerous parts. U. S. Pat. No. 3,240,183 also discloses a device having numerous parts. Furthermore, each of these patents all operate by positioning the device at different locations on the flag stick. Such an indicator has the disadvantage that the golfer may be in a position from the fairway where the indicator may not be visible due to its position on the flag stick.

Furthermore, each of these devices add weight to the flag stick and with the slidable positioning, move the center of gravity and moment of inertia of the flag stick which may cause the flag stick to sway from wind. Furthermore, these devices are smaller than the flag itself which may result in the devices being overlooked by the user unfamiliar with the devices and also since these devices may be positioned well below the flag, a golfer unaware that such a device is in use may only look to the flag itself and not notice the indicator.

Additionally, a general problem arises on the golf course when slidable indicators are utilized. During the course of the day, the flag stick is moved several times to enable the golfers to putt and is generally dropped to the putting green. Accordingly, the slidable indicators generally move from their original position to the bottom of the flag stick thus indicating an incorrect position of the golf hole.

A golf course which utilizes two co-existent golf flags of different appearances is disclosed in U. S. Pat. No. 4,664,386. This patent discloses a novel golf course having two co-existent golf holes of different sizes with the two flags having different appearances so that an advance user may aim his ball to the advanced cup and a beginner user may advance his ball to the beginner's cup.

Colorized systems are also used in golf. A fairway marker system using different colored markers is disclosed in U. S. Pat. No. 5,230,297. This patent discloses golf distance markers being placed in the golf fairway which is imbedded in the ground and which may be color coded. It is also known to use multiple flag sticks with different colored flags for indicating cup placement.

Accordingly, it is an object of the present invention to provide a cup location indicating device whereby the golfer may easily ascertain the position of the golf cup or hole on the green from the fairway or tee;

Furthermore, it is an object of the present invention, to provide an easy to use system for indicating the location of the golf cup on the green which is easily ascertainable by a golfer and which will remain stationary during the day for correctly indicating the golf cup's position; and Also, it is an object of the present invention to provide an easy to use system for indicating the location of the golf cup on the green which is easy to manufacture and which uses interchangeable components which are easy to interchange.

SUMMARY OF THE INVENTION

The above objectives are accomplished according to the present invention by providing a detachable cup indicator adapted for connection to a golf flag stick for use indicating the cup or hole position on a putting green. The detachable cup indicator includes a first golf flag having a first design for indicating a first placement of the golf hole on the green. The first golf flag is designed for easy attachment and disattachment from a flag holder.

The flag holder is tubular and is adapted for being slidably received over the top end of the flag stick. A flag holder mount is carried by the flag holder for mounting the flag holder on a top end of the flag stick for maintaining the top of the flag holder at a height generally equal to the top end of the flag stick for easy visibility. A flag holder extension is carried laterally by the flag holder and extends vertically along one side of the flag holder generally along the length of the flag holder. The flag holder extension defines a flag mounting surface which is of the same length as the first edge of the flag. A flag stick attachment is carried along the flag holder extension by the flag mounting surface. A flag attachment is carried vertically along the first vertical edge of the golf flag for releasably attaching the flag to a flag holder extension.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
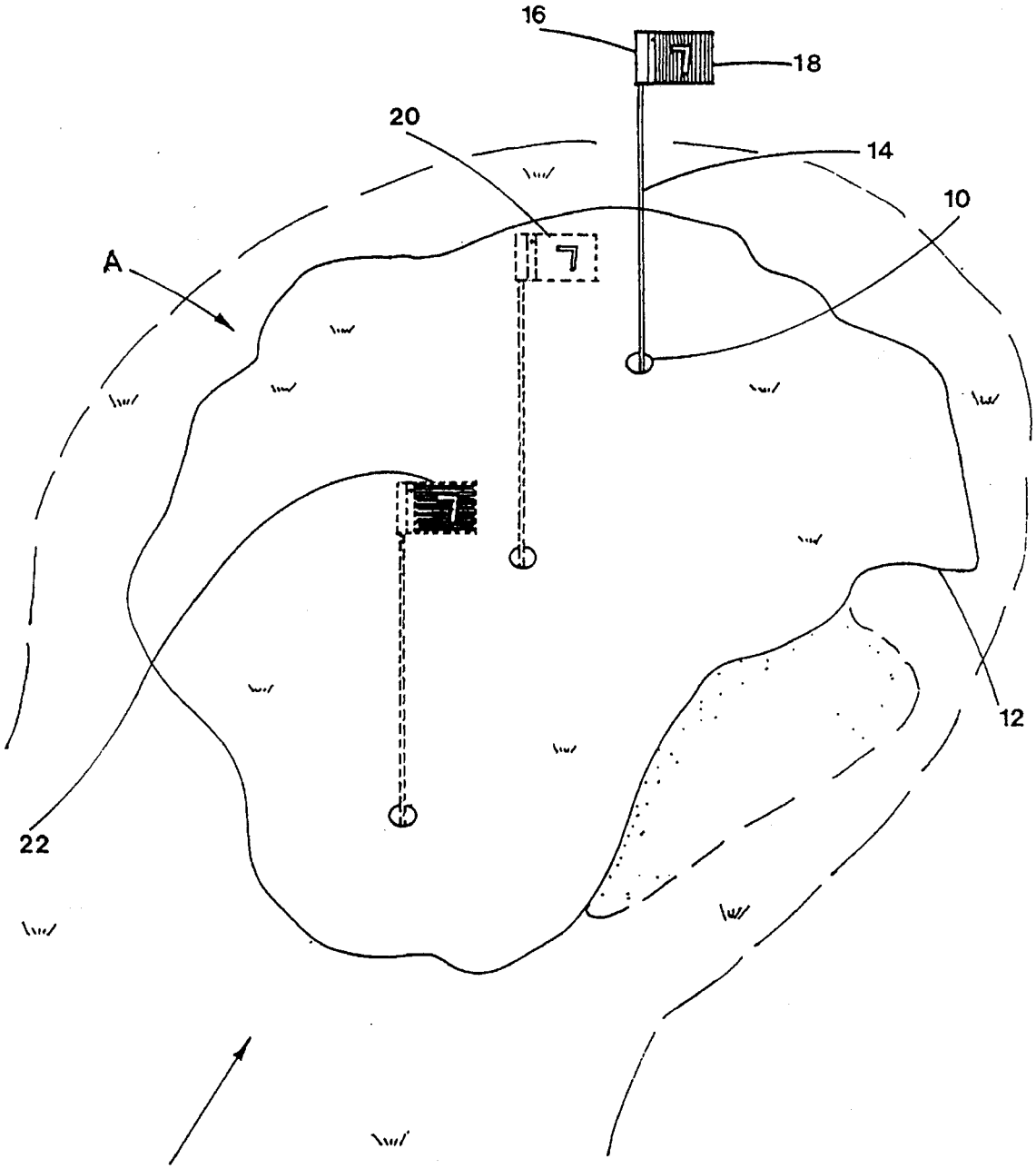
FIG. 1 illustrates a golf cup or hole location system according to the invention.

Referring now in more detail to the drawings, the invention will now be described in more detail. FIG. 1 illustrates a golf hole or cup placement system A for indicating the position of golf hole or cup 10 on putting green 12 utilizing flag stick 14. While three positions are shown, only one golf hole will exist at any given time, however this hole will have various placements on putting green 12 during the golf season.

Golf cup indicating system A utilizes flag stick 14 which carries flag holder 16 and a plurality of interchangeable and detachable flags 18, 20 and 22 which are of different designs representing the location of golf hole 10 on putting green 12 such as the front or center of the green. The system shown in FIG. 1 utilizes different designs provided by different colors. There is a red colored flag for representing a hole position closest to the front of the green, a white colored flag for representing a hole position closer to the middle of the green, and a blue flag for representing a hole position far removed from the center of the green. Of course any set of colors may be utilized, but the red, white and blue system is preferred since these colors are also used at the tee box for indicating the placements of the tee boxes closest and farthest away from the green.

Figure 2:
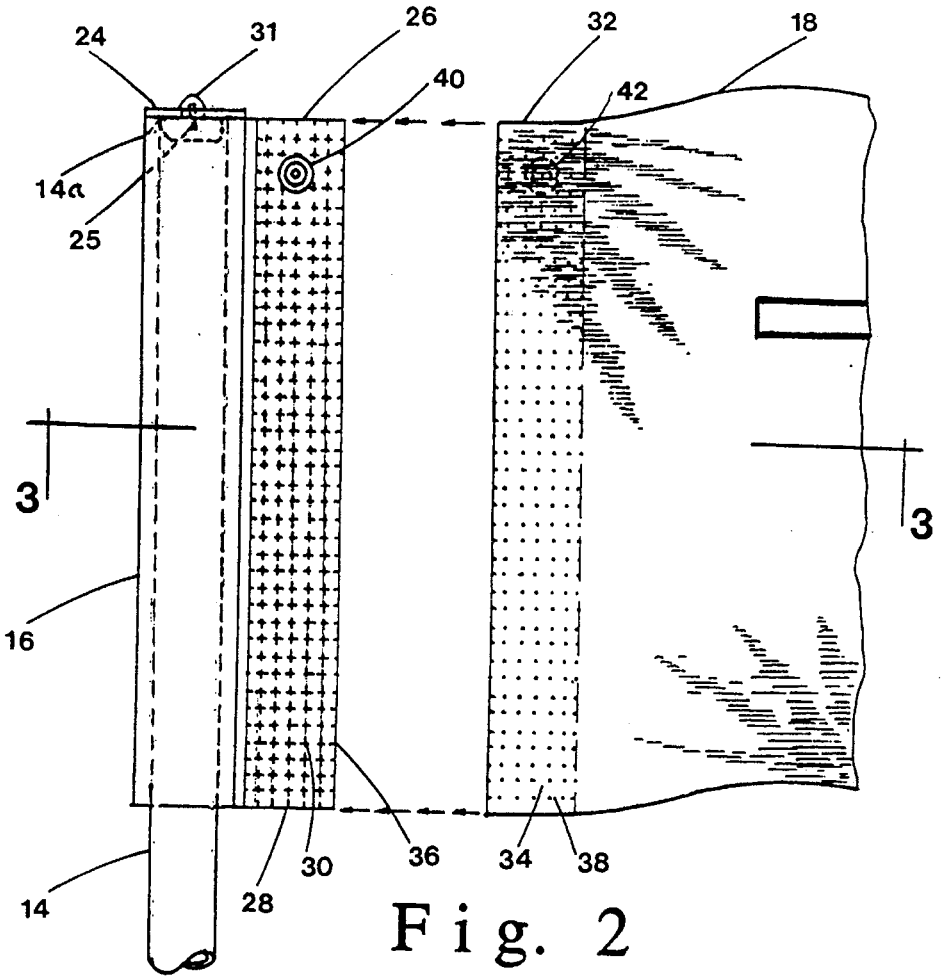
FIG. 2 illustrates a detachable golf flag in position for attachment to a flag holder for indicating the cup placement on the green according to the invention.
Figure 3:
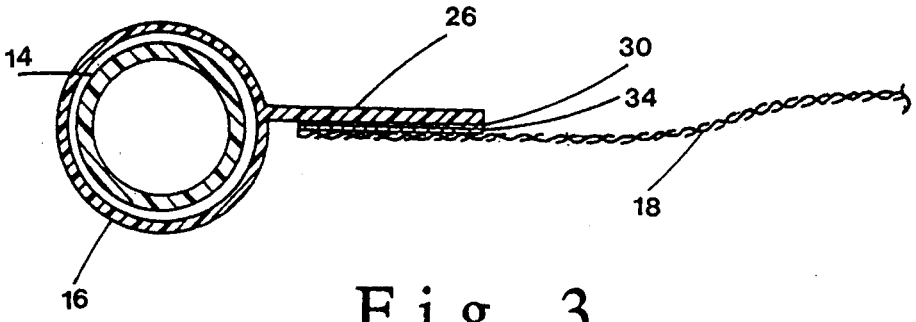
FIG. 3 is cut away view taken along line 3—3 of FIG. 2 representing a cross section of a detachable golf flag attached to a flag holder according to the invention.
Figure 7:
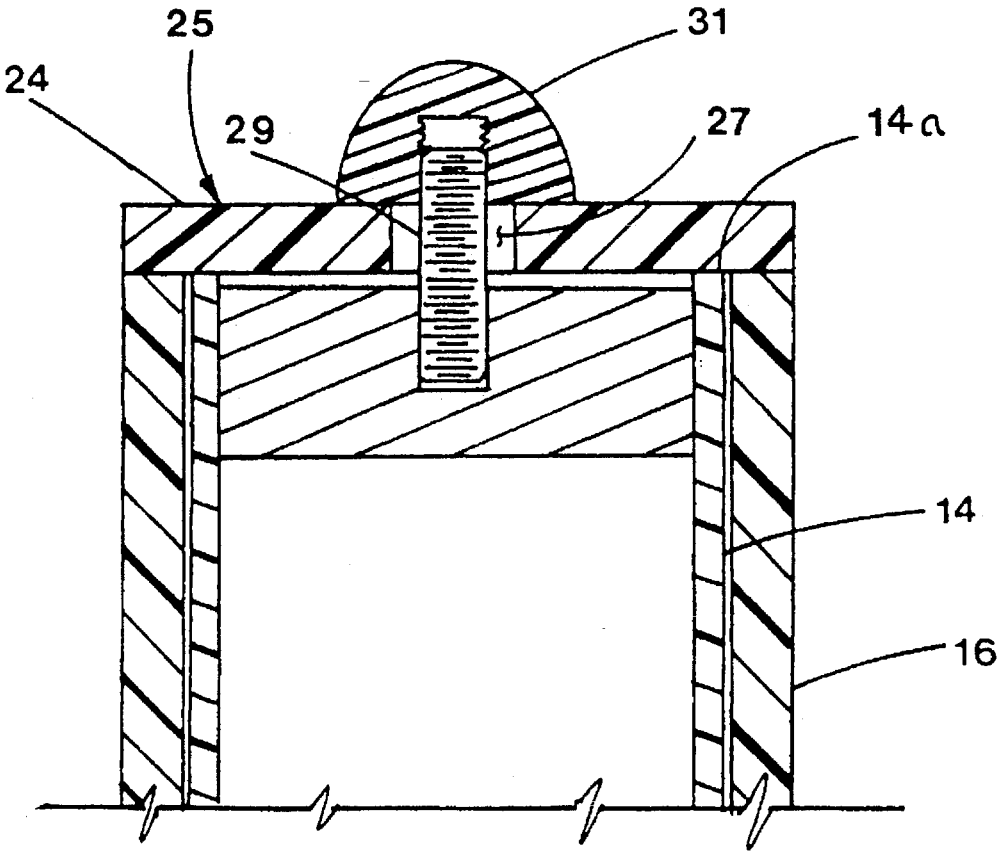
FIG. 7 is a cross sectional view of the flag holder attachment at the top of the flag stick.

FIGS. 2 and 3 illustrate flag holder 16 and detachable flag 18. Detachable flags 20 and 22 are of similar design and construction as flag 18, and only flag 18 will be described in detail. Flag holder 16 is tubular having a circumference greater than flag stick 14 and is adapted for being slidably received over top end 14a of flag stick 14. Flag holder mount 24 is carried by flag holder 16 for mounting flag holder 16 on top end 14*a* of flag stick 14. In the preferred embodiment, flag holder mount 24 includes a lip 25 which extends within the upper periphery of flag holder 16 towards the center of flag holder 16 and which forms lip aperture 27. Lip 25 abuts top end 14a of flag stick 14 for maintaining flag holder 16 at a height generally equal to the top of flag stick 14. One manner of attaching flag holder 16 to flag stick 14 is illustrated in FIG. 7. Flag stick 14 includes threaded screw 29 which extends upward from the top of flag stick 14 through lip aperture 27. Cap 31 is threaded on screw 29 maintaining flag holder 16 on flag stick 14 preventing flag holder 16 from being displaced from top end 14*a* when flag stick 14 is being moved.

Flag holder extension 26 is carried laterally by flag holder 16 and extends continuously vertical along one side of flag holder 16 generally along the length of flag holder 16 to define flag mounting surface 28. In the preferred embodiment, flag holder 16 and flag holder extension 26 are integrally molded from plastic. Flag holder extension 26 is a thin flat solid flange formed from flag holder 16. Flag holder attachment 30 is carried by flag mounting surface 28 vertically along flag holder extension 26. In the preferred embodiment flag holder 16 is thirteen and a half inches long and five eighths of an inch in diameter with flag holder extension also being thirteen and a half inches long and one and a quarter inch wide.

With flag holder 16 carrying flag holder extension 26 and flag holder 16 being retained atop top end 14*a* of flag stick 14, flag holder extension 26 is fixed axially with respect to flag stick 14. By the flag holder being retained adjacent top end 14*a* of flag stick 14, flag 18 is also relatively stationary at a height generally equal to the top of flag stick 14 for consistently and correctly indicating the position of hole 10 on green 12.

Further shown in FIGS. 2 and 3, flag 18 includes first edge 32 vertically extending along a side of flag 18. Flag 18 includes flag attachment 34 which is carried on the back side of flag 18 vertically along first edge 32 for being matingly received by flag holder attachment 30 attaching flag 18 with flag holder 16. Flag attachment 34 being releasably attached to flag holder attachment 30 enables flag 18 to be attached and detached from flag holder 16 in order to attach either flag 20 or 22 to flag holder 16 depending on the specific pin location. In the preferred embodiment flag 18 is thirteen and a half inches long and sixteen inches wide.

In order to promote the ease of use of cup placement system A, it is important that flags 18, 20 and 22 be easily attached and detached from flag holder 16. Accordingly, flag holder attachment 30 and flag attachment 34 utilize devices which are easily attached and detached. FIG. 2 illustrates that flag holder attachment 30 may consist of a first hook and loop strip 36 e.g. "Velcro", and flag attachment 34 consists of a complimentary second hook and loop strip 38 e.g. "Velcro", which easily mate for attaching flag 18 to flag holder 16. To assist in the strength of the attachment bond a snap button is also utilized. Female button receptacle 40 is attached near the top of flag mounting surface 28 for receipt of male button snap 42 which is attached near the top of first edge 32 of flag 18. The snap button is quick and easy to use for attaching flag 18 to flag holder 16. In the preferred embodiment, both Velcro strips 36 and 38 are one and one half inch in width and thirteen and a half inches long. By utilizing flag holder attachment 30 and flag attachment 34, flag 18 remains relatively stationary with respect to flag stick 14.

Figure 5:
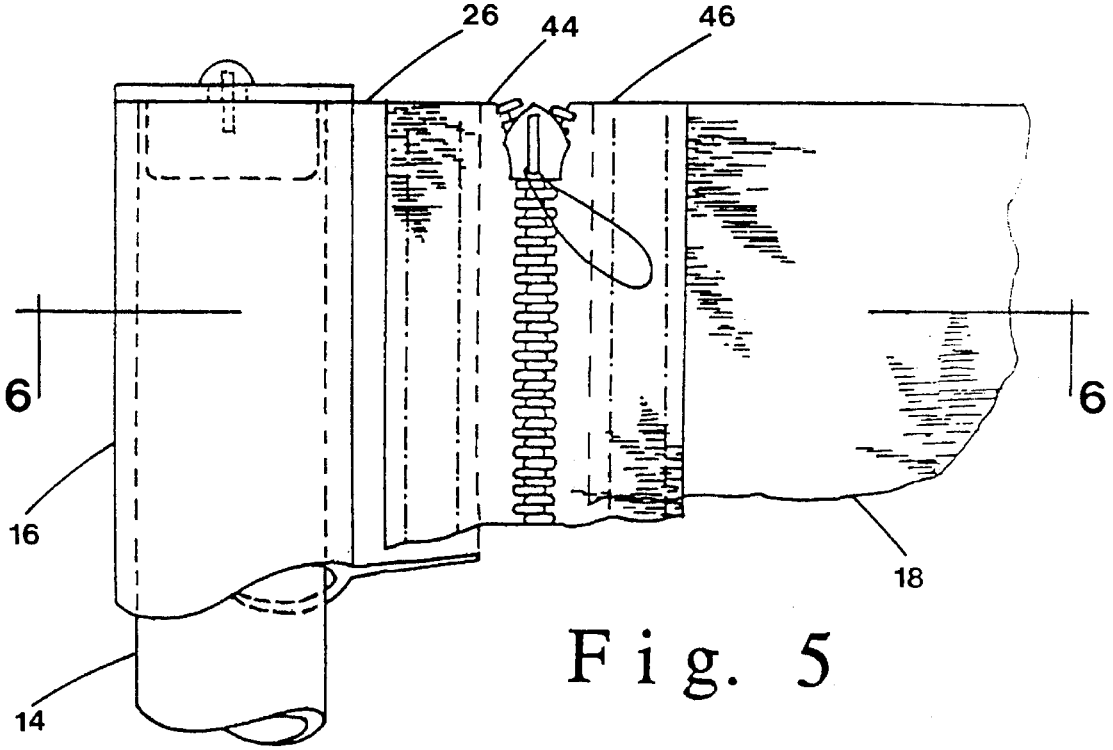
FIG. 5 illustrates another embodiment of the invention utilizing a zipper for detachably securing a golf flag to the flag holder.
Figure 6:
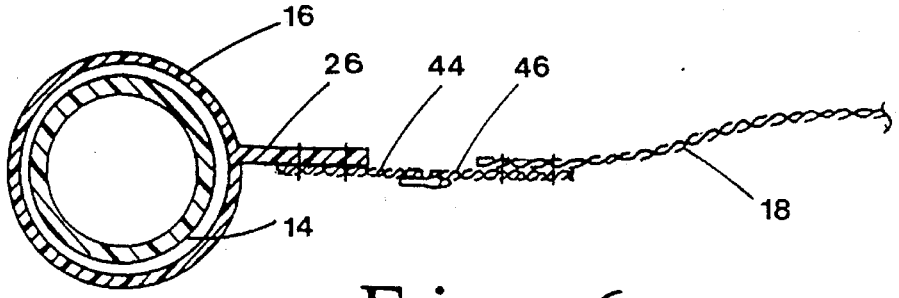
FIG. 6 is a cross section taken along line 6—6 of FIG. 5.

As shown in FIGS. 5 and 6, an alternative embodiment is illustrated where flag holder attachment 30 may consist of a first zipper element 44 and flag attachment 34 may consist of a complimentary second zipper element 46 which easily mate for attaching flag 18 to flag holder 16.

Figure 4:
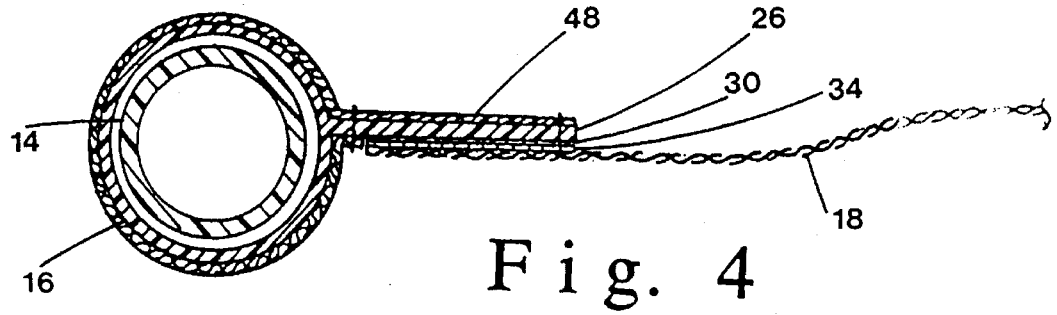
FIG. 4 illustrates another embodiment of the invention encompassing a cloth wrap wrapped around the golf flag holder.

As shown in FIG. 4, a cloth wrap 48 may be wrapped around flag holder 16 and flag holder extension 26 for providing an aesthetic appearance.

As shown in FIGS. 1, 2 and 3 an important aspect of the invention is that flag 18 functions in two roles. The first role is to indicate the number of the green being played, in this instance green number 7, as well as a cup placement flag. Golfers are accustomed to look for the flag stick and flag for indicating the general location of the golf hole. Accordingly, cup placement system A utilizes the flag component which is readily apparent to the golfers. Flag 18 is in the normal location as a standard golf hole flag at the upper part of flag stick 14. Accordingly, unlike other devices which slide down the flag stick and which may not be apparent, flag 18 is easily visible and is a device which golfers look for when shooting at the hole.

Accordingly, in operation, flag 18 which is blue will be attached to flag stick 14 when hole 10 is farthest from the front of green 12. If hole 10 is moved to the center of green 12, flag 18 will be removed from flag stick 14 and flag 20 which is white will be attached to flag stick 14 for indicating an intermediary cup placement. If hole 10 is moved to a point closest to the front of green 12, flag 20 will be removed and flag 22 which is red will be attached to flag stick 14.

Thus it may be seen that an advantageous system may be had for indicating the location of a golf hole with respect to a putting green where a set of flags indicating the placement of the golf cup can be readily attached and removed from a single flag stick. When utilized, the flags are easily visible to a golfer and are located at an expected position whereby the golfer may readily ascertain the existence and design of the indicator. The flag attachment holder supports the flags at a high visible level and provides a means for rapidly and easily attaching and detaching a respective flag according to the hole placement. While being detachable, the flags are securely attached to the flag holder providing the flags with stability to withstand wind, rain and the like.

While a preferred embodiment of the invention has been described using specific terms, such description is for illustrative purposes only, and it is to be understood that changes and variations may be made without departing from the spirit or scope of the following claims.

What is claimed is:

1. A golf cup position indicating system for identifying the location of a golf cup on a putting green, said system comprising:

a plurality of golf flags, each having a design for indicating golf cup location on said green and each having a first edge;

a flag stick having a lower end receivable in said golf cup and a top end;

a tubular flag holder having a hollow interior for receiving the top end of said flag stick;

a flag holder mount for securing said tubular flag holder on said top end of said flag stick;

a flag holder lateral extension comprising a solid plastic flange extending vertically the height of said tubular flag holder and carried laterally along one side of said tubular flag holder and extending vertically for generally the length of said tubular flag holder, said solid plastic flange defining a vertical flag mounting surface of generally the same length as said first edge of said flags;

said tubular flag holder and said flag holder lateral extension being axially fixed with respect to said flag stick when said tubular flag holder is secured with said top of said flag stick for displaying said flags at a predefined vertical height;

a flag holder attachment carried vertically along said tubular flag holder lateral extension by said flag mounting surface;

a flag attachment carried vertically along said first edge of said golf flags;

said flag holder attachment being releasably attached to said flag attachment for selectively affixing a selected one of said flag to said flag holder for indicating cup location on said green while enabling detachment of said selected one of said golf flags from said flag holder extension and replacement with a selected other golf flag having a second design for indicating another golf cup location on said green when necessary.

2. The system of claim 1 wherein each said golf flag design consists of a selected color.

3. The system of claim 1 wherein said flag holder attachment includes a first loop and hook strip and said flag attachment includes a second complimentary loop and hook strip for detachably securing said flag to said tubular flag holder.

4. The system of claim 3 wherein said flag holder attachment further includes a first snap button component and said flag attachment further includes a second complimentary snap button component for interlocking with said first snap button component for detachably securing said flag to said tubular flag holder.

5. The system of claim 4 wherein said first snap button component is attached generally near a top of said flag holder extension and said second snap button component is attached generally near a top of said flags for maintaining said flags in an upright position in the event that said loop and hook strips may become unattached.

6. The system of claim 1 wherein said flag holder attachment includes a first zipper component and said flag attachment includes a second complimentary zipper component, said first and second zipper components mating for detachably securing said flags with said tubular flag holder.

7. The system of claim 1 wherein said flag holder mount includes a lip secured with an upper periphery of said tubular flag holder for abutting said top end of said flag stick when said tubular flag holder is positioned on said top end of said flag stick, said lip acting to maintain said tubular flag holder at a height generally equal to said top end of said flag stick.

8. The system of claim 1 including a cloth wrap encasing said flag holder and said holder extension, said cloth wrap being stitched to said holder extension.

9. A system for indicating golf cup position on a putting green utilizing a golf flag stick having a top end and a plurality of individually identifiable golf flags, said system comprising:

a first golf flag having a first design for indicating a first golf cup location on a green, said first golf flag having a first vertical edge carrying a golf flag attachment member along its length;

a second golf flag having a second design for indicating a second golf cup location on a green, said second golf flag having a first vertical edge carrying a golf flag attachment member along its length;

a third golf flag having a third design for indicating a third golf cup location on a green, said third golf flag having a first vertical edge carrying a golf flag attachment member along its length;

a plastic tubular flag holder having a hollow interior for receiving said top end of said flag stick;

a flag holder mount for mounting and securing said tubular flag holder to said top end of said flag stick, a flag holder extension comprising a solid plastic flange carried laterally of and extending vertically along one side of said tubular flag holder for generally its length, said flag holder extension forming a vertical flag mounting surface of generally the same length as said first vertical edge of said golf flags;

said tubular flag holder being retained axially stationary with respect to said flag stick when said tubular flag holder is secured to the top of said flag stick for displaying said flags at a predefined vertical height;

a flag holder attachment carried vertically along said flag mounting surface;

said flag holder attachment being releasably attachable with said golf flag attachment members of said golf flags for selectively attaching said golf flags to said flag holder extension as required for indicating the position of said golf cup on the green.

10. The system of claim 9 wherein said golf flag attachment members each include a respective of a first hook and loop strip and said flag holder attachment includes a second complimentary hook and loop strip for detachably securing a selected one of said golf flags to said tubular flag holder.

11. The system of claim 10 wherein said flag holder attachment further includes a first snap button component and each said golf flag attachment further includes a respective second complimentary snap button component for interlocking with said first snap button component for detachably securing said selected one of said golf flags to said tubular flag holder.

12. The indicator of claim 11 wherein said first snap button component is attached generally near the top of said flag holder extension and said second complimentary snap button components are attached generally near the top of of said golf flags for maintaining the selected one of said flags in an upright position in the event that said hook and loop strips may become unattached.

13. The indicator of claim 9 wherein said flag holder attachment includes a first zipper component and each said golf flag attachment member includes a respective second complimentary zipper component, said first and second zipper components mating for detachably securing said selected one of said golf flags with said tubular flag holder.

14. The indicator of claim 9 wherein said flag holder mount includes a lip secured about an upper end of said tubular flag holder for abutting said top end of said flag stick for maintaining said tubular flag holder at a height generally equal to said top end of said flag stick.

15. The indicator of claim 9 including a cloth wrap encasing said tubular flag holder and said holder extension, stitching securing said cloth wrap with said holder extension.

16. A method for indicating golf cup positions on a putting green wherein said golf cup mounts a flag stick carrying a flag, said method comprising:

providing a tubular flag holder having an integral flange extending axially thereof and forming a flag mounting surface along one face of said flange, said flag mounting surface supporting first detachable flag securing means;

mounting said tubular flag holder on said flag stick in a fixed axial position;

providing a first flag having a first design for indicating a first golf cup location on said green, providing said first flag with second detachable flag securing means for releasably attaching to said first detachable flag securing means of said tubular flag holder;

providing a second flag having a second design for indicating a second golf cup location on said green, providing said second flag with second detachable flag securing means for releasably attaching to said first detachable securing means of said tubular flag holder;

providing a third flag having a third design for indicating a third golf cup location on said green, providing said third flag with second detachable flag securing means for releasably attaching to said first detachable flag securing means of said tubular flag holder;

attaching a selected of said golf flags to said tubular flag holder when said golf cup is in a forward position;

removing said selected flag from said tubular flag holder and attaching a second selected golf flag to said tubular flag holder when said golf cup is in an intermediate position;

removing said second selected flag and attaching a third selected flag to said tubular flag holder when said golf cup is in a rear position;

whereby said golf position on said green is located by the selection and attachment of an appropriately designed flag on said flag stick.

* * * * *